United States Patent [19]

Haytayan

[11] 4,346,831

[45] Aug. 31, 1982

[54] PNEUMATIC FASTENING TOOLS

[76] Inventor: Harry M. Haytayan, Sunnyside La., Lincoln, Mass. 01773

[21] Appl. No.: 110,776

[22] Filed: Jan. 9, 1980

[51] Int. Cl.[3] ..... B25C 1/04

[52] U.S. Cl. ..... 227/8; 227/130; 227/156

[58] Field of Search ..... 227/8, 130, 120, 156

[56] References Cited

U.S. PATENT DOCUMENTS

| | | | |
|---|---|---|---|
| 3,272,267 | 9/1966 | Langas | 227/156 X |
| 3,542,273 | 11/1970 | Hedrick | 227/130 |
| 3,595,460 | 7/1971 | Pitkin | 227/130 X |
| 3,612,378 | 10/1971 | Pabich et al. | 227/130 X |
| 3,708,096 | 1/1973 | Burke, Jr. | 227/130 |
| 3,776,445 | 12/1973 | Pomeroy | 227/130 |
| 4,040,554 | 8/1977 | Haytayan | 227/130 X |
| 4,227,637 | 10/1980 | Haytayan | 227/130 X |

*Primary Examiner*—Paul A. Bell
*Attorney, Agent, or Firm*—Schiller & Pandiscio

[57] ABSTRACT

Improved forms of pneumatic tools of the type shown in U.S. Pat. Nos. 4,040,554, 4,098,171 and 4,122,904 are provided for driving nail-like fasteners into a workpiece. The tool may be used for attaching small articles such as washers or name tags to the workpiece, in which event the tool may be combined with a device for holding the article and positioning it so that it will be engaged and penetrated by a fastener as the latter is discharged by the tool into a workpiece. The tools are provided with novel handle means designed to make the tool convenient and safe to use where the operator cannot or should not engage or be close to the workpiece. A further novel inventive feature is an improved form of poppet valve for causing operation of the tool.

14 Claims, 7 Drawing Figures

PNEUMATIC FASTENING TOOLS

BACKGROUND OF THE INVENTION

This invention relates to pneumatic tools in general, and more particularly to improved forms of pneumatic fastening tools.

Pneumatic fastening tools per se are not new in the art. Various examples of such tools are shown in U.S. Pat. Nos. 4,122,904, 4,098,171, 4,040,554, 3,498,577, 3,905,535, 3,776,445, 3,512,454 and 3,708,096 and the references cited therein. These tools typically comprise a housing, a cylinder disposed in the housing, a piston slidably mounted in the cylinder, a hammer connected to the piston, means for causing the piston to reciprocate within the cylinder so as to drive the hammer from a first retracted position to a second extended position, and a nozzle section for receiving a fastener and positioning it for engagement with the hammer in order to permit the hammer to drive the fastener from the nozzle into a workpiece.

It is sometimes desired that the fastening tool be used to attach small articles such as washers or name tags to the workpiece. Some tools known to be in use require the tool operator to manually position the small metal member against the workpiece and hold it there by hand or some other means while he fastens it on. This fastening technique is not satisfactory when the member being attached is small in size (thereby making it difficult and dangerous to manually hold the member in place during fastening) or when the member being attached is a washer which has a small center hole to be penetrated and therefore requires critical fastening alignment. Efforts have been made to provide tools which have means for supporting the article to be fastened so that it will be suitably secured to a workpiece by a fastener driven by the tool. However, in certain cases there still exists the need for the operator to be able to manipulate the tool into engagement with the workpiece without subjecting himself to excessive strain or risk of losing his balance and incurring injury from a fall. It also may be essential that the operator not come into contact with the workpiece in cases where the workpiece is excessively hot. The latter requirement exists in the steel industry where it is desired to attach metal identification tags to hot steel ingots or to attach insulation liners to the inside surfaces of molds used in casting steel ingots. In this connection it is well known in the steel industry that undesired large voids may appear in an ingot if premature solidification takes place in the region of the upper edges of the mold while the mold is still being filled or while the metal in the center of the mold is still molten. The typical method of preventing this solidification is to apply a liner of suitable insulation, generally available in the industry under the names Hot-Top and Riser, to the inside surface of the mold at its upper end. The insulation acts to prevent heat loss through the mold at its upper end, thereby assuring that the melt will not prematurely freeze in the mold. The preferred manner of attaching the insulation to the mold is to fasten it on by means of nail-like fasteners, with the point of the fastener penetrating the insulation and fixing itself in the wall of the mold and the head or shank of the fastener engaging a washer which in turn engages the insulation liner and holds it firmly against the mold.

Such a fastening technique involves certain obvious requirements. First of all, very high power impact drivers are required to set the fasteners. Second, the impact drivers must be mobile and relatively light in weight in order to reduce operator fatique and allow rapid advancement of the tool along the workpiece. Third the drivers must be arranged so that they can contact the work without bringing the operator in contact with the work or placing him in a precarious position. This latter problem is complicated by the fact that some fastening operations may be at waist-height while others may be at or below the level of the operator's feet. Fourthly the drivers must be designed to prevent accidental operation.

Explosive-activated impact drivers do not satisfy these requirements since they are relatively slow in operation, expensive, dangerous to operate, and suffer from substantial noise and recoil problems. Furthermore, the design and mode of operation of such tools presents significant problems to utilizing these tools around the large (e.g. 5'×4'×10') cast iron molds previously described, with operators sometimes being required to work in an awkward or tiring position when attaching the insulation to the mold.

As a result, one of the objects of the present invention is to provide a device for attaching insulation to cast iron molds which is substantially free of the problems facing explosive-activated impact tools.

Another object is to provide means for making it more convenient to use a fastener driver of the type shown in U.S. Pat. No. 4,040,554 for attaching insulation to cast iron molds.

Yet another object is to provide a fastening device which has a high degree of mobility and a unique handle and trigger extension for using the tool in hard-to-reach locations. Still another object is to provide a tool of the type described which has operating mechanisms providing a relatively high degree of safety against accidental operation.

Still another object is to provide a tool which is adapted to attach a member to a very hot workpiece, such as a newly cast steel ingot, without the operator having to place his hand next to the workpiece, thereby reducing the risk of operator injury.

A further specific object is to provide a tool of the type described which has an extension handle and embodies control means which prevent it from driving a fastener until it is engaged with a workpiece. Another specific object is to provide a pneumatic driver which cannot be operated unless the operator uses both hands and until the driver is engaged with a workpiece.

Still another specific object is to provide a relatively light weight pneumatic driver of the type described which features a light weight poppet valve of sturdy yet simple construction.

SUMMARY OF THE PRESENT INVENTION

These and other objects of the present invention are addressed by (a) providing a tool of the type which generally comprises a pneumatic driver constructed so that its operation is controlled according to the concurrent setting of a safety valve and a control valve, and (b) fitting the tool with a novel handle extension adapted for supporting and maneuvering the driver and having means for remotely operating the control valve. Optionally the driver has (1) a novel, light-weight, one-piece poppet valve which helps reduce the overall weight of the tool, and (2) means for holding an article to be fastened by the tool.

The following detailed description of several embodiments of the invention is to be considered with the accompanying drawings wherein like members refer to like parts.

THE DRAWINGS

DESCRIPTION OF THE ILLUSTRATED EMBODIMENTS

Figure 1:
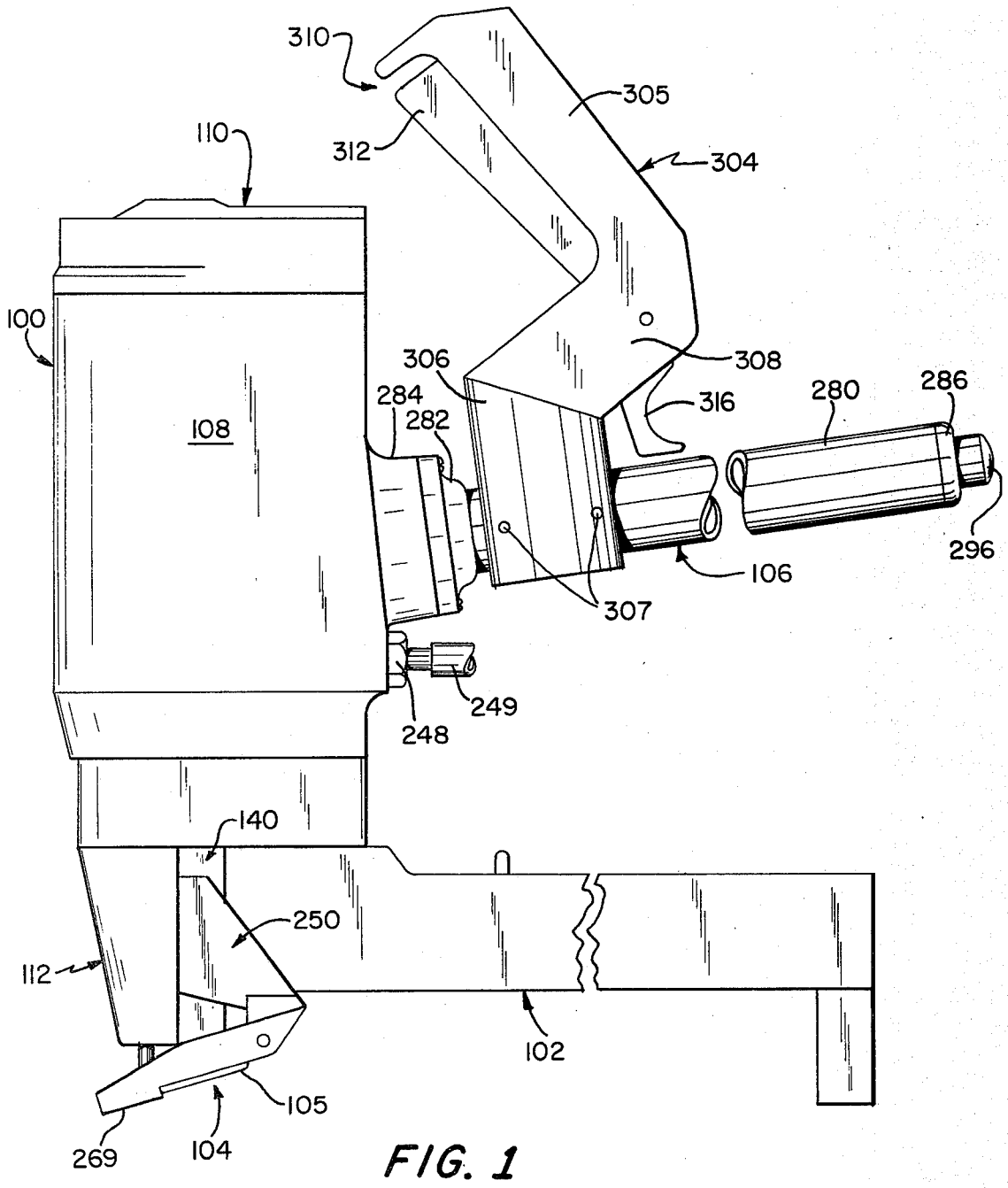
FIG. 1 is a side view in elevation showing the left side of a preferred form of a fastener driving tool made in accordance with the invention, the tool including apparatus for holding a washer to be fastened.

Referring first to FIG. 1, the fastener driving tool is generally comprised of a pneumatic driver 100 for driving selected fasteners supplied by a fastener magazine 102, a part holder 104 for holding parts where they may be engaged by a fastener and attached to a workpiece in the manner hereinafter described, and a handle assembly 106 for positioning the tool relative to the workpiece and activating it. The tool has utility where it is desired to drive fasteners with flanged heads, e.g. common nails, into a workpiece with one or more parts captivated between the head of each fastener and the workpiece. As indicated earlier, an important specific application is in steel mills where nail-like fasteners are used to secure sheets of insulating material to the top ends of the inner surfaces of molds for casting steel ingots. In such application a relatively large metal washer held by part holder 104 is mounted on each fastener as it is driven so as to provide a large area of engagement with the insulating sheets for better holding pressure and also to prevent the head of the nail from penetrating the insulating material.

The pneumatic driver 100 and the fastener magazine 102 shown in FIG. 1 are similar to the corresponding mechanisms disclosed in U.S. Pat. No. 4,040,554 but the driver has been modified in accordance with the present invention. Accordingly, driver 100 is described herein only to the extent believed necessary to understand and appreciate the present invention.

Figure 2:
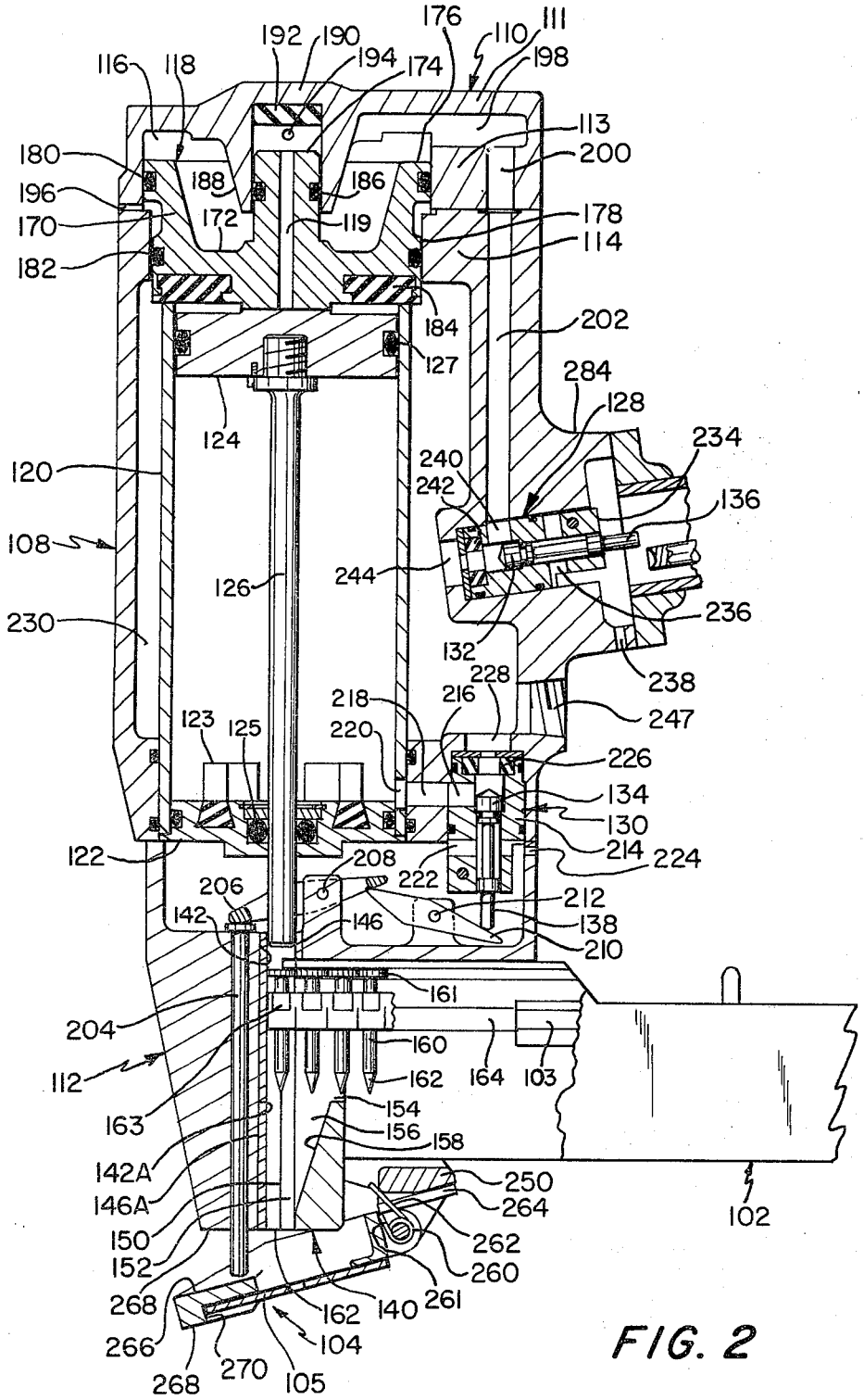
FIG. 2 is a longitudinal sectional view of the pneumatic driver of FIG. 1 showing the driver with its hammer in a retracted or ready position.

Referring now to FIGS. 1 and 2, driver 100 generally comprises an outer housing 108 which has its upper and lower ends closed off by a cap member 110 and a nozzle 112 respectively. Cap 110 and nozzle 112 are removably secured to housing 108 by suitable screw fasteners (not shown). Housing 108 is formed so that one portion 114 coacts with the end wall 111 and a side portion 113 of cap 110 to define a poppet valve casing providing a chamber 116. Housing 108 accommodates a poppet valve member 118, a cylinder 120 closed off by end wall 122, a piston 124 slidably disposed within cylinder 120, a hammer 126 attached to the piston and slidably extending through an opening in end wall 122, a control valve 128, and a safety valve 130. A rubber ring 123 attached to end wall 122 serves as a cushion for piston 124. A resilient member in the form of an O-ring 125 captivated in end wall 122 slidably surrounds and forms an air seal with hammer 126. Piston 124 has a ring seal 127 that slidably bears against cylinder 120. Preferably valves 128 and 130 comprise valve members 132 and 134 attached to actuating rods 136 and 138 respectively and are made according to the teachings of my U.S. Pat. No. 4,128,110.

Fastener magazine 102 is mounted to nozzle 112 and an intermediate face plate 140 hereinafter described. Nozzle 112 is formed with a bore 142 and is cut away along the center line of the bore for a substantial distance commencing at its lower end so as to form two flat surfaces 144 (FIG. 3) on opposite sides of the remaining half-section 142A of bore 142. The nozzle is provided with a liner for bore 142 in the form of a cylindrical sleeve 146 which is cut away like the nozzle so that a substantial section 146A thereof is semicylindrical.

Face plate 140 is removably mounted to the nozzle by means of suitable screws (not shown) which pass through suitable holes in the nozzle and are screwed into threaded bores in one side of the face plate. The other side of face plate 140 has flat surfaces which are engaged by matching flat surfaces of magazine 102. The face plate is secured to the magazine by means of suitable screws which pass through holes in the face plate and are screwed into tapped holes in the end of the magazine.

As seen in FIG. 2, face plate 140 has a flat end surface 150 engaged with the flat surfaces 144 of the nozzle and a circularly curved straight groove 152 in surface 150 defined by a semicylindrical surface having the same radius as the inner surface of liner 142. Face plate 140 also has an opening 154 through which fasteners can be delivered from the magazine. The lower region of the face plate is cut away or recessed as shown at 156 (FIG. 2) so as to provide an inclined elongated fastener guide groove 158 whose bottom has a circularly-curved cross-section with a radius of curvature smaller than the heads 161 of fasteners 160 but larger than the shanks of the same fasteners. This inclined groove 158 is directed downwardly towards the nozzle away from the magazine, arising near the face plate surface abutting magazine 102 and intersecting groove 152 near its bottom end. Groove 158 intersects face plate opening 154 below the level of the bottom ends of the fasteners 160 supported in magazine 102.

The inclined fastener guide groove 158 serves to prevent jamming. Following the impact of an indexed fastener 160 by hammer 126, the fastener guide groove surface 158 becomes the point of contact for a fastener tip 162 in the event that a cycle of operation results in a fastener being directed toward the magazine instead of coaxially along the hammer bore liner. The fastener guide groove 158 intercepts the fastener tip and thus functions as a cam surface to direct the canted fastener 160 back into full alignment with the hammer bore liner. Hence jamming is prevented as the canted fastener is "rightened" or oriented vertically back into coaxial alignment with the hammer in the course of its travel prior to its discharge from orifice 162 into a work surface.

Poppet valve member 118 is a hollow unit comprising a circumferentially-extending side wall 170, a transversely extending end wall 172 integral with side wall 170, and a center post portion 174 coaxial with hammer 126. Side wall 170 comprises two axially-spaced sections 176 and 178 with cylindrical outer surfaces of larger and smaller diameters respectively and seals 180 and 182 in sections 176 and 178 for making fluid-tight sliding engagement with adjacent inner surfaces of the portions 113 and 114 of the poppet valve casing. The upper side of the poppet valve has a larger effective area than its lower side. End wall 172 has a bottom end face formed with a recess with reentrant portions in which is molded and captivated a resilient sealing member 184 that preferably is made of a suitable natural or synthetic rubber or a plastic material, e.g., a silicone rubber. The bottom surface of sealing member 184 is flat so that it can make a full and tight seal with the flat upper end surface of cylinder 120. The post section 174 of poppet valve member 118 has a groove to accommodate a sealing member in the form of a resilient O-ring 186 that makes an hermetic sliding seal with the surrounding surface of an interior wall portion 188 of cap member 110. Wall portion 188 forms part of an exhaust valve casing which also includes an end wall 190, a resilient end seal 192, and one or more exhaust ports 194 that communicate with the atmosphere exterior of the tool. A port 196 in cap member 110 communicates with the groove formed between section 176 and 178 of the poppet valve member side wall to facilitate reciprocal movement of that member. Cap member 110 also is formed so as to define a chamber 198 that communicates with poppet valve chamber 116 and a passageway 200 that connects chamber 198 to a passageway 202 in housing 108 leading to control valve 128.

Nozzle 112 has a bore in which is slidably supported a valve actuating safety rod 204. The upper end of rod 204 engages one end of a lever 206 which is pivotally supported at 208 in a hollowed out upper end portion of nozzle 112 and has its other end in engagement with one end of a second lever 210. The latter is pivotally supported at 212 in the hollowed out upper end portion of the nozzle and has its other end in engagement with actuating rod 138 of safety valve 130.

Valve 130 comprises a valve casing 214 secured by a roll pin or other suitable means in a bore in the bottom end of housing 108 Casing 214 is provided with a side port 216 that communicates via passageways 218 and 220 with the interior of cylinder 120 below piston 124. Valve casing 214 also has one or more second side ports 222 that communicate with the atmosphere via a vent opening 224 in the upper hollow end of nozzle 112. Secured in the upper end of casing 214 is an annular valve seat 226 which forms a port that is connected via an opening 228 in housing 108 to an air reservoir chamber 230 that surrounds cylinder 120.

Valve casing 214 is formed with a second valve seat which is below valve member 134 and is engaged by the valve member when the latter is in its down position (FIG. 2). So long as valve member 134 is engaged tightly with its second valve seat, it will block off vent port(s) 222 from side port 216 and permit opening 228 to communicate with side port 216. When valve member 134 is lifted off at its second valve seat and engaged with valve seat 226, opening 228 is effectively closed off from side port 216 and the latter is open to vent ports 222.

Control valve 128 is identical in construction to safety valve 130. It also has a valve casing 234 that is secured by a roll pin or other means in a transversely extending bore 235 in housing 108. Valve casing 234 has one or more vent ports 236 that communicate with an opening 238 in a boss 284 found integral with the side wall of housing 118, and a side port 240 that communicates with poppet valve passageway 202. Secured in the inner end of casing 234 is a first annular valve seat 242 which forms a port that is connected to air reservoir 230 via an opening 244 in the side wall of housing 108. Valve casing 234 also is formed with a second valve seat which is between valve member 132 and vent port(s) 236 and is engaged by valve member 132 when the latter is moved away from valve seat 242 (FIG. 2). When valve member 132 is lifted off of its second valve seat and engaged with its valve seat 242, opening 244 is effectively closed off and side port 240 is open to vent port(s) 236. Opening 244 is open to passageway 202 and closed to port(s) 236 when the valve member is engaged with its second valve seat as in FIG. 2.

Reservoir 230 is suitably energized with compressed air by way of an inlet 247 that is threaded to receive a hose fitting 248 for connecting it via a suitable hose line 249 to a compressor or other source of compressed air (now shown), e.g. air at 150 psi.

With the exception of the shape and construction of the poppet valve member and the manner in which control valve 128 is mounted to housing 108, to the extent described above the tool of FIGS. 1 and 2 is already known.

Figure 3:
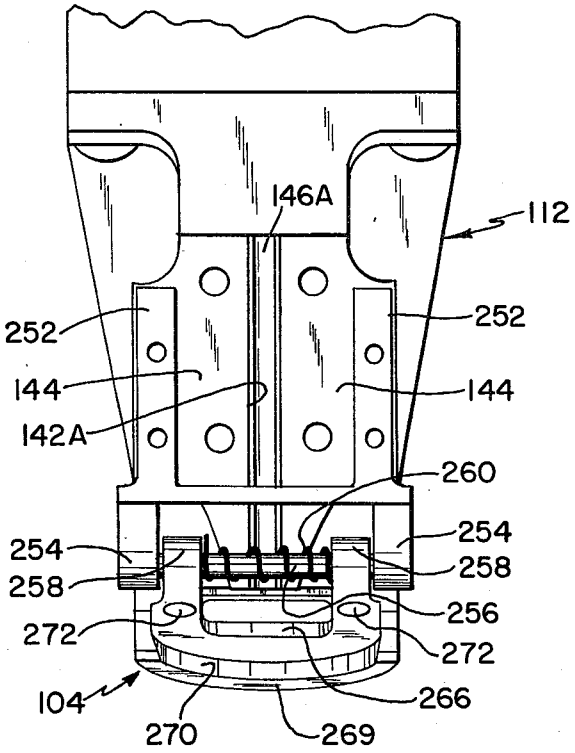
FIG. 3 is an enlarged front view in elevation of the nozzle of the driver of FIG. 1 with the washer holder attached thereto but the fastener magazine omitted.
Figure 4:
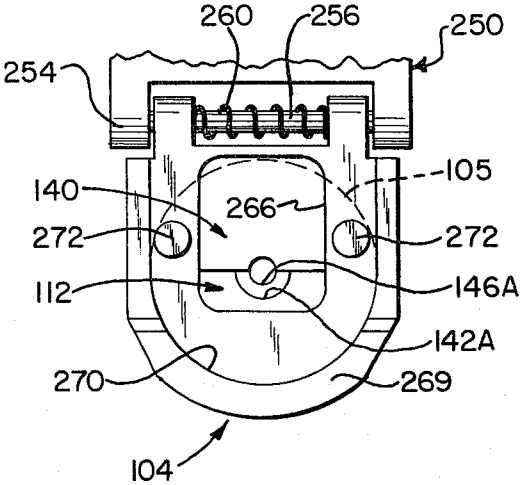
FIG. 4 is a bottom plan view of the washer holder.

Turning now to FIGS. 2–4, the part holder 104 is adapted to hold circular metal washers 105 which are to be secured to a workpiece by fasteners 160. Fasteners 160 are contained in plastic sleeves 163 which are connected together in series and are adapted to be detached one from the other by a shearing force applied by hammer 126. Preferably the plastic sleeves are made as shown in FIG. 1 of my U.S. Pat. No. 4,106,618, issued Aug. 15, 1978, so as to be easily detachable from one another by hammer 126 and also so as to be slidably supported and guided by grooves 164 formed in opposite sides of magazine 102. Washer holder 104 is pivotally attached to a U-shaped bracket 250 (FIG. 3) having two arms 252 that are releasably attached to the flat faces 144 of nozzle 112 by suitable screw fasteners (not shown). Bracket 250 has two ears 254, and a pivot shaft 256 is secured to and extends between those ears. Washer holder 104 itself has two ears 258 having holes to rotatably accommodate shaft 256. A spring 260 surrounds shaft 256 and is arranged with one end 261 thereof engaging holder 104 and opposite end 262 thereof engaging bracket 250 (FIG. 2), so that it biases the part holder away from the bottom end surface of nozzle 112, i.e. the position shown in FIG. 2. Holder 104 has a portion 264 that is disposed so as to engage the underside of bracket 250 and limit pivotal movement of the part holder away from nozzle 112. Pivot shaft 256 is located so that when holder 104 is swung toward nozzle 112, it will be stopped by engagement of the upper end surface 266 of the holder with the lower end surface 268 of the nozzle.

Holder 104 is a plate having a hole 266 which is substantially larger than the heads of the fasteners 160 to be deployed. On its underside holder 104 also has a circularly-curved flange 269 which in this case extends for less than 180°. Flange 269 is disposed so that when the holder is swung far enough for its surface 266 to engage nozzle surface 268, the inner surface 270 of the flange will be concentric with hammer 126 and located so that the center hole of a washer 105 held by the holder will be substantially aligned with the axis of the hammer.

Also safety rod 204 is engaged by the upper surface 266 of holder 104 when the latter is swung toward nozzle 112. Flange 269 functions as a washer positioning guide and also as a workpiece-engaging toe for holder 104. A pair of cylindrical magnets 272 are secured in suitable bores in holder 104 in position to hold a metal washer against flange 269.

Figure 5:
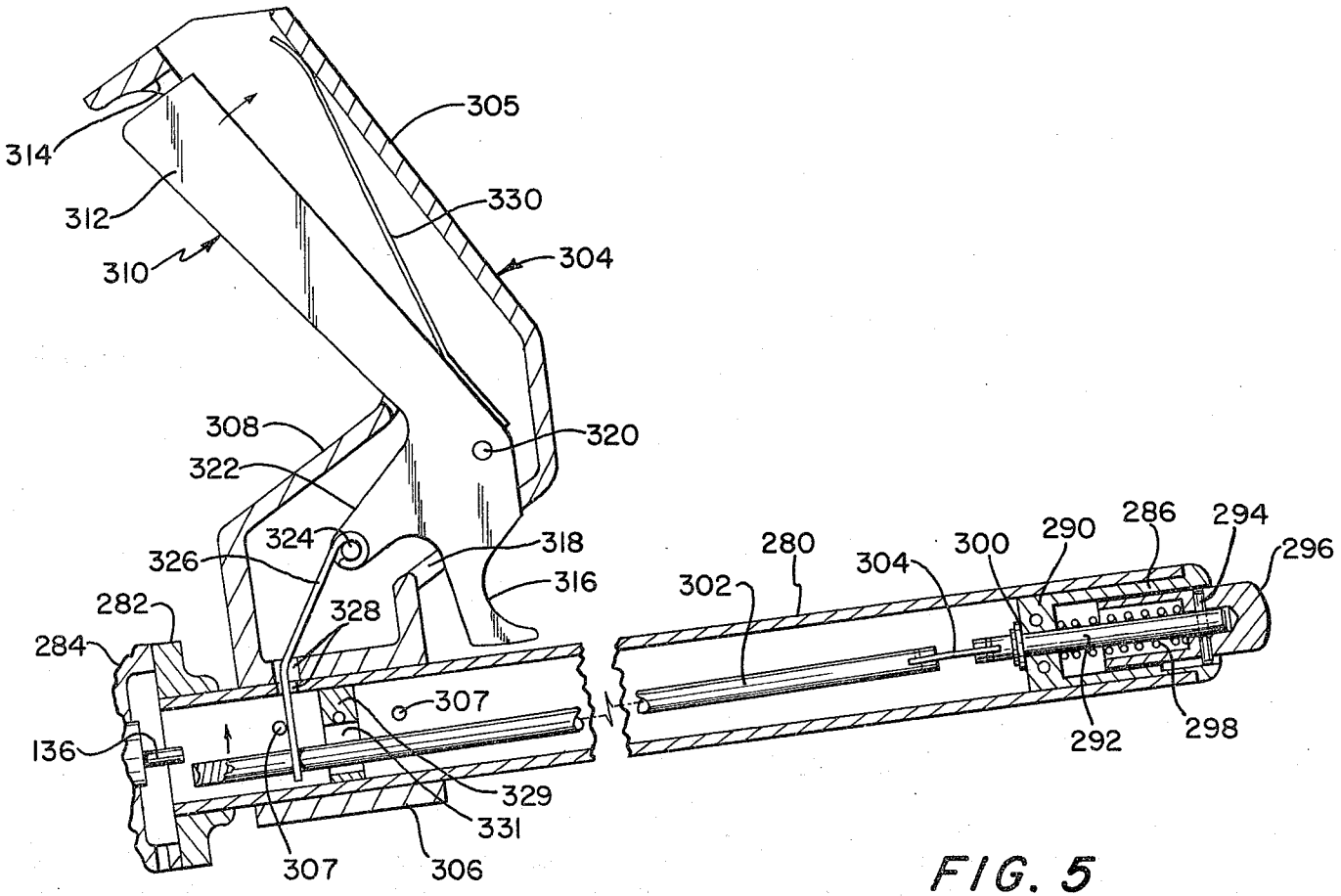
FIG. 5 is an enlarged longitudinal sectional view of the extension handle mechanism of the device of FIG. 1.

Referring now to FIGS. 1, 2 and 5, the tool further includes a preferred form of extension handle 106 having means for operating control valve 128. In this case the extension handle 106 comprises a rigid hollow tube 280 having a collar 282 affixed to one end. Collar 282 is attached to boss 284 on housing 108 by suitable means, e.g. releasably secured by suitable screw fasteners, so that tube 280 projects away from the side wall of housing 108 in concentric relation with control valve casing 234. Secured within the outer end of tube 280 is a sleeve 286 having a wall 290 at its inner end. Wall 290 has a center hole in which a first operating rod 292 is slidably positioned. The outer end of rod 292 is secured by a roll pin 294 to a button 296 which is slidably received in sleeve 286. A compression spring 298 engaged with end wall 290 urges button 296 away from housing 108. A flange 300 on rod 292 is disposed to engage end wall 290 and thus act as a stop to limit movement of button 296 by spring 298. Rod 292 is connected to a second operating rod 302 by a flat leaf spring 304. The length of rod 302 is set so that it terminates close to but slightly short of the outer end of control valve rod 136 when button 296 is in its outer limit position, yet is long enough to engage valve rod 136 and shift valve member 132 against seat 242 when button 296 is depressed toward wall 290.

Attached to tube 280 is a hollow handle 304 which consists of a grip section 305, a collar section 306 which surrounds tube 280 and is attached thereto by pins 307, and an offset section 308 which connects sections 305 and 306. Mounted within grip section 305 is a trigger 310 comprising a first portion 312 which normally projects through a slot 314 in grip section 305 and a second portion 316 which projects through a slot 318 in offset section 308. Trigger 310 is pivotally secured to handle 304 by a pivot pin 320 and has a lateral extension 322 carrying a pin 324. Trigger 310 is connected to rod 302 by a wire link 326, the latter having one end pivotally secured to pin 324 and the other end bent around and slidably connected to rod 302. Tube 280 and collar section 306 have aligned side openings 328 through which wire link 326 movably extends. A leaf spring 330 attached to trigger 310 bears against an inside surface of grip section 305 and urges the trigger counter clockwise about pivot 320 (as seen in FIG. 5) so as to cause link 326 to force the inner end of rod 302 out of alignment with operating rod 136 of control valve 128. The slot 318 is sized to limit movement of trigger 312 so that it is movable between a relaxed position (FIG. 5) in which link 326 holds rod 302 to one side of valve rod 136, and a closed position in which link 326 holds rod 302 in substantially exact alignment with valve rod 136. A ring 329 secured in tube 280 has an elongate slot 331 for rod 302 that is arranged so as to allow lateral movement of rod 302 only in the plane of the drawing and also to stop the rod from moving over-center relative to valve stem 136 when trigger 310 is squeezed. Thus, it is believed to be obvious that if button 296 is pressed while trigger 310 is in its relaxed position, rod 302 will not engage valve rod 136. However, if trigger 310 is moved to its closed position, depressing button 296 will cause rod 302 to engage valve rod 136, forcing the latter inwardly. The maximum length of travel of button 296, determined by its engagement with end wall 290 of sleeve 286, is such as to allow rod 302 to shift valve member 132 up against its valve seat 242. When button 296 is released, spring 298 will cause rod 302 to move away from valve rod 136, thus permitting valve member 132 to move back against its other valve seat under the pressure of air in reservoir 230.

Figure 7:
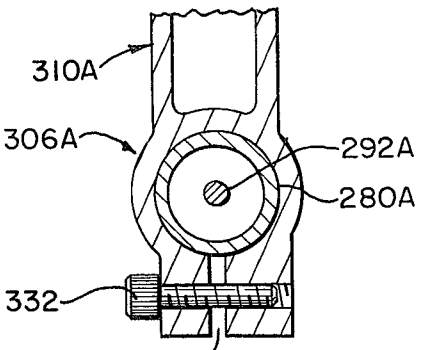
FIG. 7 is a cross-sectional view taken along line 7—7 of FIG. 6.
Figure 6:
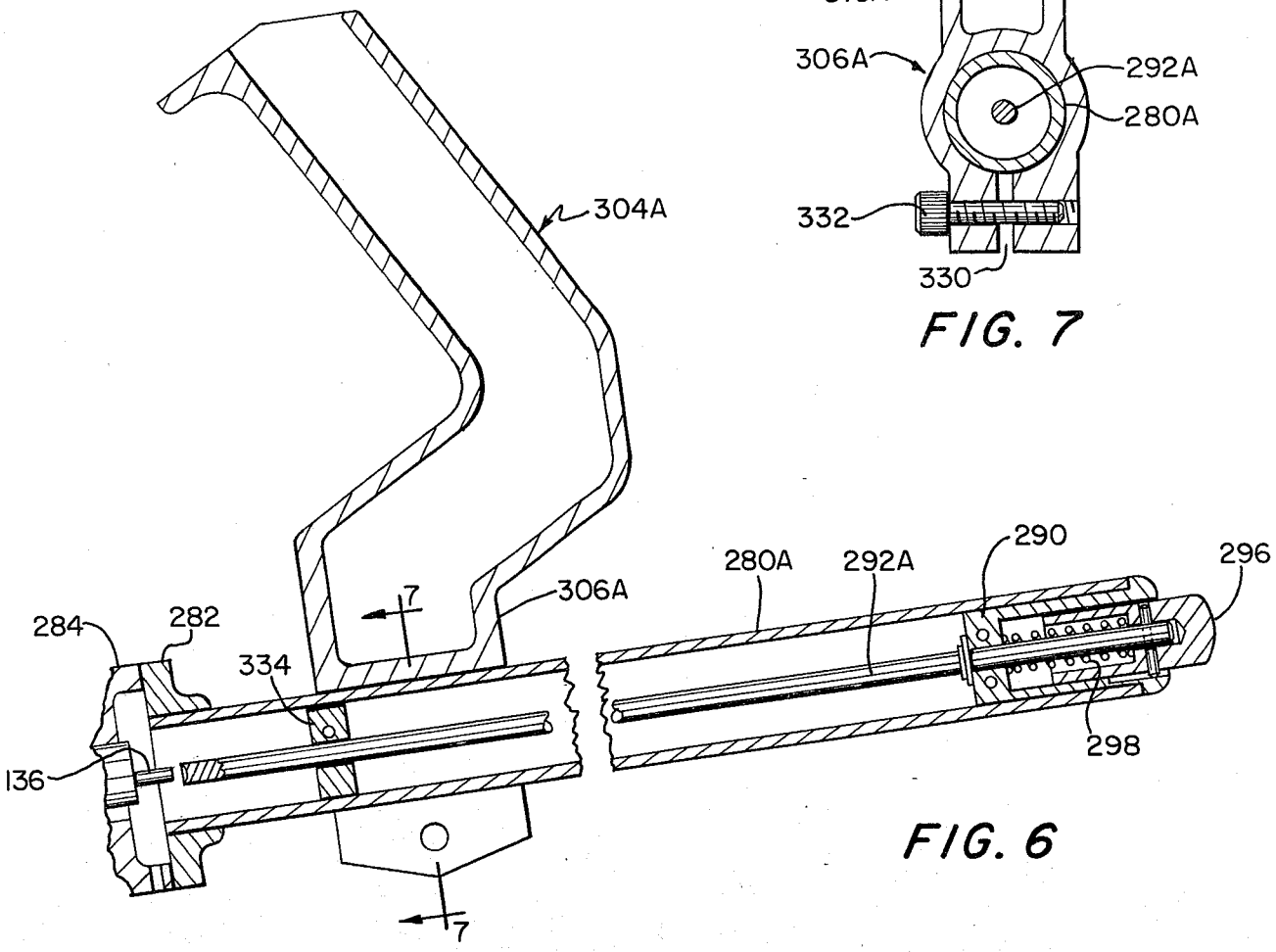
FIG. 6 is an enlarged longitudinal sectional view of a modified form of handle extension.

FIGS. 6 and 7 show a modified form handle extension. In this case tube 280A does not require a side opening 328 since handle 304A does not carry a trigger. Instead handle 304A has a collar section 306A which is split at one side as shown at 330 so as to form two opposed halves which are adapted to embrace tube 280A and include aligned holes, one of which is threaded, to accommodate a screw 332. Screw 332 serves to releasably clamp the two halves of the collar section to tube 280A. This embodiment also differs from the one shown in FIG. 5 in that rod 302 and leaf spring 304 are omitted and rod 292A extends for substantially the full length of tube 280A and is slidably received by a guide ring 334 located within and fixed to the tube near housing 108. Guide ring 334 holds rod 292A aligned with valve rod 136. When button 296 is in its outer limit position (FIG. 6), rod 292A is disengaged from valve rod 136. However, if button 296 is depressed to its inner limit position, rod 292A will engage rod 136 and shift valve member 132 up against its valve seat 242. On release of button 296, spring 298 will shift rod 292A out of engagement with valve rod 136, thus allowing valve member 132 to move back against its other valve seat.

Operation of the tool of FIGS. 1–5 will now be described. First an air hose 249 is coupled to fitting 248 so that the driver is suitable energized with compressed air. Then a clip of fasteners consisting of fasteners 160 mounted in strip of plastic sleeves 163 is loaded into the magazine and are urged forward into the hammer travelway defined by liner 146 and groove 152 of face piece 140 by a suitable spring-biased pusher 103 forming part of the magazine. Next a washer 105 is placed up against the bottom of holder 104 so that the washer engages flange 268. The tool is now ready for use.

At this point it is to be noted that when pressurized air is supplied via inlet 247, it passes through the orifice 244 and acts on a valve head 132 to close off opening 240 from vent ports 236. The air passing through orifice 244 also proceeds through opening 240, passageway 202 and chamber 198 into chamber 116, where it applies a force to the upper end of poppet valve 118 and urges the latter to assume the position shown in FIG. 2 wherein the rubber disc 184 forms a tight seal with the upper edge of cylinder 120. Simultaneously pressurized air proceeds through the orifice 228 (FIG. 2) into safety valve 130 to urge the valve member 134 down against its lower valve seat so as to prevent a discharge of air from cylinder 120 via its vent ports 222. The pressurized air entering the chamber of safety valve 130 via port 228 passes through openings 216, 218 and 220 into the interior of cylinder 120, thereby providing a force on the underside of piston 124 which holds the piston up against the sealing disc 184 of poppet valve member 118. Any air trapped between the upper end of the piston and the disc 184 is exhausted to the atmosphere via a center bore 119 in the poppet valve and vent ports 194. At this point the device is in its normal "primed" state and cannot be fired unless safety mechanism actuator rod 204 is forced upwardly far enough for valve member 134 to move off of its lower valve seat. If control valve 128 should be operated so as to close off opening 244 while rod 204 is in the down position shown in FIG. 2, the air pressure acting on the upper side of the poppet valve 118 will be released by a discharge of air from chamber 198 via openings 240 and 236. As a result, the pressure in reservoir 230 will then move poppet valve 118 up and thereby allow pressurized air to act on the upper end of piston 124. However, no movement of the piston will occur because an equilibrium force condition exists as a result of the opposing force of the pressurized air acting on the bottom surface of piston 124 and the additional static frictional forces due to the engagement of seal 127 with the cylinder 108 and the rod-like hammer 126 with stationary seal 125. If, however, safety rod 204 is pushed far enough upwards so that links 206 and 210 cause valve member 134 to block off orifice 228, the air pressure acting on the underside of piston 124 is rapidly exhausted to the atmosphere by outflow of air via passageway openings 210, 216, 222 and 224. If thereafter the valve member 132 is moved so as to close off orifice 244 while safety rod 204 is still pushed upwards, poppet valve 118 will move up rapidly and the full line pressure in reservoir 230 will act on the upper end of piston 124 so as to cause the latter to move rapidly through its normal firing stroke so as to engage hammer 126 with a fastener 160 (advanced by magazine 102) and thereby drive it from the nozzle discharge hole 162. The piston will not return to its normal starting position until valve members 132 and 134 are both returned to the positions shown in FIG. 2. Then the driver will be ready to fire again, a new fastener having been automatically loaded into the firing chamber by pusher 103 of fastener magazine 102. It is to be noted that the air pressure in reservoir 230 urges the valve members 132 and 134 to maintain the positions shown in FIG. 2.

The tool of FIGS. 1–5 normally is used as hereinafter described. After placing a washer 105 on holder 104, the operator places one hand around the upper end of tube 280 and the other around grip 305 of handle 304, and then positions the work holder 104 against a workpiece. In the case of preparing molds for casting steel ingots, the workpiece consists of an insulation liner which is to be fastened to the inside surface of a mold. As the workpiece is engaged the washer holder 104 is forced inwards against end surface 268 of the nozzle. As this is done, safety rod 204 is simultaneously depressed by the rear side of holder 104 so as to cause valve 130 to change states and place the tool in a "ready" condition. Now trigger 310 is squeezed and button 296 is depressed, whereupon valve 128 changes states and the tool is caused to operate and fire the lead fastener 160 out of the nozzle. The shank of the fired fastener passes through the center hole of the washer in holder 104 and the head of the fastener engages the washer, thereby carrying the washer forward with the fastener to the workpiece. The fastener penetrates the insulation liner and enters the side wall of the mold far enough for the head or the shank of the fastener to clamp the washer against the liner. Button 296 is maintained in a depressed position as the driver's recoil brings the tool away from the workpiece, with washer holder 104 returning to its angular position (FIG. 2) and allowing valve 130 to reverse itself. When button 296 is released, the poppet valve releases and piston 124 returns to its top position. Thereafter a new washer is placed in holder 104 to make the tool ready for another fastening.

The same mode of operation is achieved if the tool has the handle extension of FIGS. 6 and 7, except that only one hand is required to operate the tool. Nevertheless the embodiment of FIG. 6 is quite advantageous, particularly where the workpiece is located below the operator's feet. A further advantage of the device of FIG. 6 is that handle 304A may be moved lengthwise along tube 280A to whatever position is most comfortable for the operator.

The embodiment of FIG. 5 is preferred since it requires two hands to operate the tool, thus improving operator safety. While handle 204 is locked in place near the bottom of tube 280, it is to be understood that it and openings 328 could be located further from housing 108 and still provide adequate lateral movement of rod 302. A further advantage of the device of FIG. 5 is that it is adapted to facilitate application of fasteners where the fasteners have to be driven toward the operator, as, for example, when the operator is standing next to a mold at near waist height and it is desired to fasten insulation to the side of the mold nearest the operator. In such case the operator places both hands around tube 280, one hand in position to press button 296 and the other hand in position for one edge of its palm to engage the curved edge of trigger section 316 and press it toward housing 108 far enough to operate valve 128.

MODIFICATIONS OF THE INVENTION

It is understood that the embodiments illustrated and described herein are intended as examples and are not to be considered as limiting the scope of the present invention, since various alterations and modifications may be carried out on the illustrated embodiments without departing from the essential features of the invention. In this connection it should be noted that it is not necessary for the tool to include part holder 104 since there are many applications where it is not necessary to combine a washer or other part with the fastener to be deployed. Also the part holder may have some other purpose or construction. Thus, it could be made to hold a metal identification tag to be secured to a metal ingot or it could be attached to the nozzle in some other manner, e.g., so that it moves toward and away from the nozzle without any pivoting action. Also the tool could be adapted so that safety rod 204 is actuated by engaging it directly with the workpiece.

In any event it is obvious that tubes 280 and 280A may be made in any suitable length. Also if desired those tubes or handles 304 and 304A could be provided with means for attaching the tools to a rope or cable suspended from an overhead support, whereby to relieve the operators from holding the tools when not in use. As an alternative cylindrical tubes 280 and 280A could be replaced by tubes of other cross-sectional shapes or by a pair of elongate parallel mutually spaced bars with rods 302 or 292A extending between those bars, in which case the handle unit may have to be modified for attachment to the two bars.

Other obvious advantages of the forms of handle extensions herein described are that they are rugged, relatively cheap, and easy to disassemble and repair.

Of course other forms of poppet valve, control valve and safety valve may be used. However, the poppet valve herein described is especially advantageous since it has low mass (and thus can be operated very fast) and is quite compact in an axial direction so that chamber 116 and its operating stroke are relatively short.

Still other modifications and advantages will be obvious to persons skilled in the art.

What is claimed is:

1. In a fastener driving tool for holding and attaching parts to a workpiece, said tool comprising a driver and a parts holder attached to said driver;

said driver comprising a nozzle having a hammer travelway, means for positioning a fastener in said travelway, a hammer mounted for reciprocal movement along said travelway, a piston attached to said hammer, a cylinder slidably containing said piston, operating means for causing said hammer to move through a drive stroke and a return stroke along said travelway, said operating means comprising means including a control valve and means responsive to said control valve for selectively (a) applying a high pressure gas to one side of said piston so as to urge said piston to move said hammer through its drive stroke or (b) removing high pressure gas from said one side of said piston so as to permit said piston to move said hammer through its return stroke, and safety means for preventing said operating means from causing said hammer to move through its said drive stroke until said safety means is operated, said safety means comprising means including a safety valve for selectively (a) applying a high pressure gas to the other side of said piston so as to urge said piston to move said hammer through its return stroke or (b) removing high pressure gas from said other side of said piston so as to permit said piston to move said hammer through its drive stroke, said safety means comprising an actuating member arranged to operate said safety valve when said actuating member is depressed; and said parts holder comprising a part support member adapted to support in the path of movement of said hammer a part intended to be fastened to a workpiece, and means movably supporting said part support member for movement toward and away from said nozzle so that when said part support member is engaged with a workpiece and moved toward said nozzle a selected amount, said actuating member will be depressed by said workpiece, said part support member or a part supported by said part support member, whereby said driver may be operated to drive a fastener out of said hammer travelway into a workpiece with said fastener penetrating the part held by said part support member as it is discharged from said travelway;

the improvement comprising a tool support member attached to and extending away from said housing; an operating rod slidably supported by said support member and adapted to engage and operate said control valve, force-transmitting means for moving said operating rod so as to engage and operate said control valve, and additional means for selectively preventing said operating rod from operating said control valve when said operating rod is moved by said force-transmitting means.

2. A fastener driving tool according to claim 1 including spring means urging said part support member away from said nozzle.

3. Apparatus according to claim 1 wherein said parts holder comprises magnetic means for holding a part made of metal.

4. A fastener driving tool according to claim 1 wherein said actuating member is a rod slidably mounted in said nozzle, and said control valve has an operating stem in position to be engaged by said operating rod.

5. A fastener driving tool according to claim 1 wherein said operating rod is movable sideways by said additional means.

6. A fastener driving tool according to claim 1 wherein said tool support member is a hollow tube surrounding at least a portion of said operating rod.

7. A fastener driving tool comprising:

a hollow housing having first and second opposite ends;

end means for closing off said first end of said housing, said end means having an extension with an opening therein communicating with the interior of said housing;

a hammer disposed within said opening and longitudinally movable therein between a first retracted position and a second extended position with said first retracted position being nearer to said second end of said housing than said second extended position;

means for positioning a fastener in the path of said hammer so that it may be discharged from said end means extension by said hammer as said hammer moves from said first position to said second position;

means for driving said hammer from one to the other of its said first and second positions, with at least some of said means being disposed within said housing;

said means for driving said hammer comprising a cylinder within said housing, piston means attached to said hammer and slidably disposed within said cylinder, a high pressure air reservoir outside of said cylinder, a poppet valve having a poppet valve member movable from a first position where it engages and closes off a first end of said cylinder and a second position where said first end of said cylinder is open and communicates with said reservoir, a high pressure air feed passageway, a vent valve for venting air from said first end of said cylinder when said first end is closed off by said poppet valve member, a control valve for selectively directing high pressure air (a) from said air feed passageway to said poppet valve so as to cause said poppet valve member to close off said first end of said cylinder or (b) away from said poppet valve so as to cause said poppet valve member to open up said first end of said cylinder, a safety valve for selectively directing high pressure air (a) from said reservoir into the second end of said cylinder so as to urge said piston toward said first end of said cylinder when said first end of said cylinder is closed off by said poppet valve member, or (b) out of said second end of said cylinder so as to cause said piston to move toward said second end of said cylinder when said poppet valve is opened and said first end of said cylinder is supplied with high pressure air from said reservoir, and an actuating member arranged to operate said safety valve when said actuating member is depressed; and handle means for supporting said tool, said handle means comprising an elongate rigid member attached to said housing proximate to said control valve, an operating rod slidably mounted to said elongate member for operating said control valve, force-transmitting means for causing said operating rod to move and thereby to engage and operate said control valve, and additional means for selectively preventing said operating rod from operating said control valve when said operating rod is moved by said force-transmitting means.

8. A fastener driving tool according to claim 7 wherein said operating rod is moveable sideways by said additional means.

9. A fastener driving tool according to claim 8 further including a handle member attached to and extending laterally from said rigid member and adapted to be gripped by a person desiring to use the tool.

10. A fastener driving tool according to claim 9 wherein at least some of said additional means are carried by said handle member.

11. A fastener driving tool according to claim 10 wherein said poppet valve includes a poppet valve casing, and further wherein said poppet valve member comprises a side wall, an end wall formed integral with said side wall at one end thereof, a central post formed integral with said end wall, and a bore in said central post and said end wall, with said side wall, said end wall, and said central post defining a first recess on a first side of said valve member, said side wall having first and second axially spaced cylindrical outer surfaces in close sliding relation with said casing, said first surface having a larger diameter than said second surface, said first recess being open to the interior of said casing, and further wherein said poppet valve member has a second recess formed in said end wall opposite said first recess, and a resilient member mounted and captivated in said second recess in position to engage and close off said first end of said cylinder.

12. A fastener driving tool according to claim 8 wherein said rigid member is hollow and said operating rod is disposed in said rigid member.

13. A fastener driving tool according to claim 12 wherein said force-transmitting means comprises a button mounted in the end of said rigid member and spring means urging said operating rod out of engagement with said control valve.

14. A fastener driving tool according to claim 8 wherein said rigid member is hollow and said operating rod is disposed in said rigid member, and further wherein said additional means comprises a handle attached to said rigid member, a trigger movably attached to said handle, link means connecting said trigger and said operating rod so that said operating rod will move sideways when said trigger is moved in a selected direction relative to said handle, stop means engageable by said operating rod for limiting sideways movement of said operating rod in a first direction, said operating rod when engaged with said stop means being in position to engage said control valve, and spring means for urging said operating rod in a second opposite direction so as to maintain said operating rod in a position wherein it is prevented from engaging and operating said control valve.

* * * * *